US006350565B1

(12) United States Patent
Bringley et al.

(10) Patent No.: US 6,350,565 B1
(45) Date of Patent: Feb. 26, 2002

(54) COLOR PHOTOGRAPHIC ELEMENT EXHIBITING INCREASED RED SPEED

(75) Inventors: Joseph F. Bringley; James A. Friday; Marcello Vitale, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/690,230

(22) Filed: Oct. 17, 2000

(51) Int. Cl.[7] ..... G03C 1/46

(52) U.S. Cl. ..... 430/506; 430/505; 430/507; 430/510; 430/567; 430/383

(58) Field of Search ..... 430/505, 506, 430/567, 507, 510, 383

(56) References Cited

U.S. PATENT DOCUMENTS 4,539,289 A 9/1985 Saito et al.
5,300,413 A 4/1994 Sutton et al.
5,601,967 A * 2/1997 Brust et al. ..... 430/505
5,763,145 A * 6/1998 Ling ..... 430/506
5,939,246 A * 8/1999 Brewer et al. ..... 430/505
5,998,114 A 12/1999 Bringley et al.
6,001,548 A 12/1999 Bringley et al.
6,245,497 B1 * 6/2001 Eikenberry et al. ..... 430/567

* cited by examiner

*Primary Examiner*—Geraldine Letscher
(74) *Attorney, Agent, or Firm*—Arthur E. Kluegel

(57) ABSTRACT

A color photographic element containing a support bearing:

(a) a red record comprising, in order from the support, a less and a more red light sensitive silver halide emulsion layer, each having associated therewith at least one cyan dye-forming coupler;

(b) further from the support a green record comprising, in order from the support, a less and a more green light sensitive silver halide emulsion layer, each having associated therewith at least one magenta dye-forming coupler, and (c) still further from the support, a blue record comprising in order from the support, a less and a more blue light sensitive silver halide emulsion layer, each having associated therewith at least one yellow dye-forming coupler;

wherein:

(d) there is located below and only below the most red light sensitive layer of the red record a relatively non-light sensitive "small 3-D emulsion layer" that is substantially free of red light absorbing dye.

14 Claims, No Drawings

COLOR PHOTOGRAPHIC ELEMENT EXHIBITING INCREASED RED SPEED

CROSS REFERENCE TO RELATED APPLICATIONS

Co-filed herewith is an application Ser. No. 09/690,310, directed to a light sensitive color photographic element containing a speed improving nitrogen heterocycle with at least 3 heteroatoms and a reflector layer and an application Ser. No. 09/690,564, directed to a light sensitive color photographic element containing such a speed improving nitrogen heterocycle with at least 3 heteroatom and a certain class of Electron Transfer Agent Releasing Compounds (ETARCs).

FIELD OF THE INVENTION

This invention relates to color photographic silver halide elements containing a non-light sensitive light reflecting 3-D silver halide emulsion layer below the most sensitive red light sensitive layer.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces that are clearly larger than any remaining crystal face and having an aspect ratio of at least 5.

The term "3-D" indicates a grain that is not a tabular grain as defined above.

The term "tabular grain emulsion" refers to an emulsion in which tabular grains account for greater than 50 percent of total grain projected area.

The term "non-tabular grain emulsion" refers to an emulsion in which tabular grains account for greater than 50 percent of total grain projected area.

The term "small 3-D grain emulsion" refers to a tabular or non-tabular grain emulsion in which at least 20 mol % of the grains in the emulsion are 3-D grains having an ECD in the range of 0.1 to 0.8 $\mu$m.

The term "{111} tabular" in referring to grains and emulsions indicates those in which the tabular grains have parallel major crystal faces lying in {111} crystal planes.

The term "high bromide" in referring to grains and emulsions indicates that bromide is present in a concentration greater than 50 mole percent, based on total silver.

In referring to silver halide grains and emulsions containing two or more halides, the halides are named in order of ascending concentrations.

The terms "blue", "green" and "red" indicate the portions of the visible spectrum lying, respectively, within the wavelength ranges of from 400 to 500 nm, 500 to 600 nm and 600 to 700 mn.

The term "minus blue" indicates the visible portion of the spectrum outside the blue portion of the spectrum—e.g., any spectral region in the range of from 500 to 700 nm.

The term "half peak absorption bandwidth" indicates the spectral region over which a dye exhibits an absorption equal to half its peak absorption.

The terms "front" and "back" indicate a position that is nearer or farther, respectively, than the support from the source of exposing radiation, with the support being on the back.

The terms "above" and "below" indicate a position nearer or farther, respectively, from the source of exposing radiation, with the support being on the bottom.

The term "subject" designates the person(s) and/or object (s) photographed.

The term "stop" in comparing photographic speeds indicates an exposure difference of 0.3 log E required to produce the same reference density, where E is exposure in lux-seconds.

The term relatively non-light sensitive when referring to the grains of an emulsion means that the emulsion exhibits no more than 10% of the sensitivity of any of the red-light sensitive layers, as measured by red toe speed.

The term "maximum gamma" is herein defined as the highest observed ratio of $\Delta D/\Delta E$, where $\Delta D$ is the increase in density that occurs in response to an increase in exposure $\Delta E$.

BACKGROUND OF THE INVENTION

Photographic images that allow re-creation or approximation of the natural hues of a subject are conventionally captured on photographic film mounted in a camera. Camera speed films typically employ high bromide silver halide emulsions. Separate images of each of blue, green and red exposures are captured in blue, green and red recording layer units within the film. The blue recording layer unit contains chemically sensitized high bromide grains that may either rely on native blue sensitivity or are spectrally sensitized to the blue region of the spectrum with one or more blue absorbing spectral sensitizing dyes. The green recording layer unit contains chemically sensitized high bromide grains that are sensitized to the green region of the spectrum with one or more green absorbing spectral sensitizing dyes. The red recording layer unit contains chemically sensitized high bromide grains that are sensitized to the red region of the spectrum with one or more red absorbing spectral sensitizing dyes. Dye-forming couplers are typically included in the layer units to allow dye images of distinguishable hue to be formed upon color processing. When the photographic film is intended for reversal processing to produce a viewable color positive image or when the photographic film is intended for use in exposing a color paper, the blue, green and red recording layer units contain couplers that form blue absorbing (yellow), green absorbing (magenta), and red absorbing (cyan) image dyes, respectively. When the dye image information is intended to be retrieved from the photographic film by digital scanning, the dye images can be of any hue, provided they are distinguishable. The layer units in a camera speed film are coated so that exposing radiation is first received by a blue recording layer unit, then a green recording layer unit, and finally a red recording layer unit. When two or more layer units differing in speed are provided for recording in a single spectral region, the exposing radiation receiving coating sequence of the slower, but not the faster recording layer units, is sometimes varied.

The high bromide silver halide grains incorporated in the green and red (minus blue) recording layer units of camera speed films have significant blue sensitivity. Coating the blue recording layer unit over the minus blue recording layer units protects the latter from blue light contamination.

The components used to construct color photographic films are disclosed in *Research Disclosure*, Vol. 389, September 1996, Item 38957. *Research Disclosure* is published by Kenneth Mason Publications, Ltd., Dudley House, 12 North St., Emsworth, Hampshire P010 7DQ, England. The following topics of Item 38957 are particularly pertinent to the present invention:

I. Emulsion grains and their preparation (most particularly the last sentence of paragraph (1) of B. Grain morphology);

II. Vehicles, vehicle extenders, vehicle-like addenda and vehicle related addenda;

IV. Chemical sensitization;

V. Spectral sensitization and desensitization A. Sensitizing dyes;

X. Dye image formers and modifiers (except A. silver dye bleach);

XI. Layers and layer arrangements;

XII. Features applicable only to color negative;

XIII. Features applicable only to color positive (except C. Color positives derived from color negatives);

XV. Supports.

Sutton et al U.S. Pat. No. 5,300,413 discloses high bromide {111} tabular grain emulsions with grain dispersities and thicknesses controlled to facilitate red light reflection.

Bringley and Friday U.S. Pat. No. 5,998,114 discloses a color photographic element comprised of a transparent film support and, coated on the support, a red recording layer unit containing the radiation-sensitive silver halide grains in a plurality of emulsion layers with each emulsion layer located to receive exposing radiation prior to an underlying emulsion layer containing silver halide grains of higher sensitivity than the silver halide grains located in the underlying emulsion layer. The red light reflective layer is free of red absorbing dye and contains tabular silver halide grains having a thickness in the range of from 0.03 to 0.12 $\mu$m, an average aspect ratio of greater than 20, and a coating coverage of 0.5 to 1.25 g/m$^2$, and formed of greater than 50 mole percent bromide, based on silver. The reflective layer is located in the red recording layer unit interposed between two emulsion layers.

Bringley and Friday U.S. Pat. No. 6,001,548 discloses a color photographic element comprised of a transparent film support and, coated on the support, a red recording layer unit containing the latent image forming silver halide grains in a plurality of emulsion layers with the latent image forming silver halide grains of maximum sensitivity being the first red recording emulsion layer to receive exposing radiation and containing randomly oriented red light reflecting silver halide grains free of adsorbed spectral sensitizing dye, at a coating coverage of 0.01 to 0.2 g/m$^2$. An optional layer coated beneath the first layer contains tabular silver halide grains to reflect red light. Improvements in imaging speed with improvements or relatively low losses in image sharpness are realized.

The human eye obtains about 60 percent of its visual information from the green region of the spectrum. About 30 percent of visual information comes from the red region of the spectrum, and only about 10 percent of visual information comes from the blue region of the spectrum.

The red recording layer unit, being coated beneath the blue and green recording layer units, is placed in the optically least favored position in the photographic film. In this least favored position the speed and sharpness of the red recording layer unit are degraded by any red light absorption and reflecting that occurs in the overlying layer units.

The speed of the red recording layer unit can be increased by increasing the sensitivity of the silver halide grains in this layer unit. A common technique for accomplishing this is to increase the mean ECD of the grains. Unfortunately, it is well recognized in the art that each stop increase in speed arrived at by increasing grain size can be expected to increase image granularity by 7 grain units.

Saito et al. U.S. Pat. No. 4,539,289 discloses a silver halide light-sensitive material "comprised of a support, comprising thereon at least two emulsion layers having the same color sensitivity and being different light sensitivities, with a layer containing comparatively light insensitive silver halide grains of 0.05 to 0.60 um in average grain size being positioned in at least one of two interspaces defined by every two adjacent members of said at least two emulsion layers".

Saito only shows use of the light insensitive layer in conjunction with the blue light sensitive layer. Since it is normally thought that reflecting or reflecting to improve speed would be expected to degrade sharpness, no mention is made of improved sharpness when the reflecting layer is used relative to the blue or any other layer.

A problem to be solved is to increase the speed of a red sensitive record while maintaining or improving the sharpness of the record.

SUMMARY OF THE INVENTION

The invention provides a color photographic element containing a support bearing:

(a) a red record comprising, in order from the support, a less and a more red light sensitive silver halide emulsion layer, each having associated therewith at least one cyan dye-forming coupler;

(b) further from the support a green record comprising, in order from the support, a less and a more green light sensitive silver halide emulsion layer, each having associated therewith at least one magenta dye-forming coupler, and (c) still further from the support, a blue record comprising in order from the support, a less and a more blue light sensitive silver halide emulsion layer, each having associated therewith at least one yellow dye-forming coupler;

wherein:

(d) there is located below and only below the most red light sensitive layer of the red record a relatively non-light sensitive "small 3-D emulsion layer" that is substantially free of red light absorbing dye.

The invention also includes an imaging method.

The invention provides improved red speed while maintaining or improving the sharpness of the record.

DETAILED DESCRIPTION OF THE INVENTION

The invention is generally described above. In one aspect, this invention is directed to a color photographic element comprised of a transparent film support and, coated on the support, blue, green and red recording layer units containing couplers that form first, second and third image dyes, respectively, each of the layer units being comprised of radiation-sensitive silver halide grains containing greater than 50 mole percent bromide, based on silver, for forming a developable latent image upon imagewise exposure, and at least the red recording layer unit containing the radiation-sensitive silver halide grains in a plurality of emulsion layers with each emulsion layer located to receive exposing radiation prior to an underlying emulsion layer containing silver halide grains of higher sensitivity than the silver halide grains located in the underlying emulsion layer, wherein, a red light reflective layer free of red absorbing dye and containing a silver halide grain emulsion with 3-D grains having an ECD of from 0.10 to 0.80 $\mu$m, preferably from 0.30 to 0.60 μm, and a coating coverage of 0.4 to 1.25 g/m$^2$, preferably 0.6 to 1.00 g/m$^2$. Suitably, each of the first, second and third image dyes exhibits a half-peak absorption bandwidth that occupies at least one 25 nm spectral region not occupied by the remaining of the first, second and third image dyes. Typically, the non-sensitive emulsion is formed of greater than 50 mole percent bromide, based on silver, is located in the red recording layer unit interposed between two of the emulsion layers.

The reflecting layer is a relatively non-light sensitive that is substantially free of red light absorbing dye if the sensitivity of the layer to red light is at least 0.5 logE slower than the least red sensitive layer.

The addition of the red light reflective layer is capable of increasing the speed and/or gamma of the red recording layer unit. Further, the enhancement of these photographic properties is realized with little or no image degradation in the granularity of the red recording layer unit and with improved or equal sharpness.

When such a reflecting layer is used above the most red light sensitive layer the advantages are not obtained. Nor are the advantages obtained using such a layer having tabular grain morphology.

A simple construction of a color photographic element satisfying the requirements of the invention is illustrated by the following:

| |
|---|
| Protective Overcoat |
| Blue Recording Layer Unit |
| Green Recording Layer Unit |
| Red Recording Layer Unit |
| Antihalation Layer Unit |
| Transparent Film Support |
| (I) |

Each of the blue, green and red recording layer units incorporate high bromide silver halide grains for latent image formation upon imagewise exposure. The high bromide grains preferably each contain greater than 70 mole percent bromide and optimally greater than 90 mole percent bromide, based on total silver. The grains can form latent image sites at the surface of the grains, internally or at both locations, but preferably form latent image sites primarily at the surface of the grains. The portion of the silver halide not accounted for by silver bromide can be any convenient conventional concentration of silver iodide and/or chloride. Silver iodide can be present up to its solubility limit in silver bromide, typically cited as 40 mole percent, based on total silver. However, iodide concentrations of less than 20 mole percent are preferred and iodide concentrations of less than 10 mole percent, based on total silver, are most preferred. Silver chloride concentrations are preferably limited to less than 30 mole percent and optimally less than 10 mole percent, based on total silver. Silver iodobromide grain compositions are specifically preferred. Other contemplated grain compositions include silver bromide, silver chlorobromide, silver iodochlorobromide and silver chloroiodobromide. The latent image forming silver halide gains can take the form of those disclosed in *Research Disclosure*, Item 38957, cited above, I. Emulsion grains and their preparation.

In a specifically preferred form the latent image forming silver halide grains in at least the minus blue (i.e, green and red) recording layer units are provided by chemically and spectrally sensitized {111} tabular grain emulsions. Similar latent image forming silver halide grains can be employed in the blue recording layer unit, although non-tabular grain emulsions are often used in the blue recording layer unit for latent image formation in combination with minus blue layer units that incorporate tabular gain latent image forming emulsions. Specific illustrations of high bromide tabular grain emulsions are provided by the following patents, here incorporated by reference:

List T

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et at U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927;
Daubendiek et al U.S. Pat. No. 5,576,168;
Olm et al U.S. Pat. No. 5,576,171;
Deaton et al U.S. Pat. No. 5,582,965;
Maskasky U.S. Pat. No. 5,604,085;
Reed et al U.S. Pat. No. 5,604,086;
Eshelman et al U.S. Pat. No. 5,612,175;
Levy et al U.S. Pat. No. 5,612,177;
Wilson et al U.S. Pat. No. 5,614,358;
Eshelman et al U.S. Pat. No. 5,614,359;
Maskasky U.S. Pat. No. 5,620,840;
Wen et al U.S. Pat. No. 5,641,618;
Irving et al U.S. Pat. No. 5,667,954;
Maskasky U.S. Pat. No. 5,667,955;
Maskasky U.S. Pat. No. 5,691,131;
Maskasky U.S. Pat. No. 5,693,459;
Black et al U.S. Pat. No. 5,709,988;

Jagannathan et al U.S. Pat. No. 5,723,278;
Deaton et al U.S. Pat. No. 5,726,007;
Irving et al U.S. Pat. No. 5,728,515;
Bryant et al U.S. Pat. No. 5,728,517;
Maskasky U.S. Pat. No. 5,733,718;
Jagannathan et al U.S. Pat. No. 5,736,312;
Antoniades et al U.S. Pat. No. 5,750,326;
Brust et al U.S. Pat. No. 5,763,151; and
Maskasky et al U.S. Pat. No. 5,792,602.

Typically the {111} tabular grain emulsions are those in which the {111} tabular grains account for greater than 50 percent, preferably 70 percent and optimally 90 percent, of total grain projected area. High bromide emulsions in which {111} tabular grains account for substantially all (>97%) of total grain projected area are disclosed in the patents of List T cited above and are specifically contemplated. The {111} tabular grains preferably have an average thickness of less than 0.3 $\mu$m and most preferably less than 0.2 $\mu$m. It is specifically contemplated to employ ultrathin tabular grain emulsions in which the tabular grains having a thickness of less than 0.07 $\mu$m account for greater than 50 percent of total grain projected area.

When tabular grain emulsions are relied upon for latent image formation in the blue recording layer unit, they can have the thickness characteristics noted above. However, to obtain speed by absorption of blue light within the grains, it is recognized that the tabular grains having a thickness of up to 0.50 $\mu$m can account for at least 50 percent of total grain projected area in the blue recording layer units.

The high bromide {111} tabular grains preferably have an average aspect ratio of at least 5, most preferably greater than 8. Average aspect ratios can range up to 100 or higher, but are typically in the range of from 12 to 60. The average ECD of the latent image forming emulsions is typically less than 10 $\mu$m, with mean ECD's of less than 6 $\mu$m being particularly preferred to maintain low levels of granularity.

The latent image forming high bromide emulsions are chemically sensitized. Any of the chemical sensitizations of *Research Disclosure*, Item 38957, IV. Chemical sensitization, cited above as well as the patents, incorporated by reference, of List T, above, can be employed. One or a combination of sulfur, selenium and gold sensitizations are commonly employed. Additionally, the epitaxial sensitization of the grains is contemplated.

In all instances the latent image forming grains in the minus blue recording layer units are spectrally sensitized. The green recording layer unit contains one or a combination of green absorbing spectral sensitizing dyes adsorbed to the surfaces of the latent image forming grains. The red recording layer unit contains one or a combination of red absorbing spectral sensitizing dyes adsorbed to the surfaces of the latent image forming grains. The latent image forming grains of the blue recording layer unit can rely entirely on native blue absorption, particularly when the grains contain iodide. Preferably the blue recording layer unit contains one or a combination of blue absorbing spectral sensitizing dyes adsorbed to the surfaces of the latent image forming grains. Spectral sensitizing dyes and dye combinations can take the forms disclosed in *Research Disclosure*, Item 38957, V. Spectral sensitization and desensitization, A. sensitizing dyes, and in the patents, here incorporated by reference of List T.

In addition to silver halide grains the dye image forming layer units contain dye image-forming couplers to produce image dyes following imagewise exposure and color processing. When the photographic elements are intended to be used for exposing a color paper or to form viewable reversal color images, the blue, green and red recording layer units contain dye-forming couplers that form on coupling yellow, magenta and cyan image dyes, respectively. When the photographic elements are intended to be scanned, an image dye of any convenient hue can be formed in any of the blue, green and red recording layer units, provided that the image dyes can be differentiated by inspection or scanning. To facilitate scanning each image dye is contemplated to exhibit a half peak absorption bandwidth of at least 25 nm, preferably 50 nm, that does not overlap the half peak absorption bandwidth of any image dye in another recording layer unit. Dye image-forming couplers can take any of the various forms disclosed in *Research Disclosure*, Item 38957, X. Dye image formers and modifiers, B. Image-dye-forming couplers.

The red recording layer unit is made up of at least two latent image forming emulsion layers of differing speeds. Common coating arrangements include "double coated" red recording layer units containing a fast and a slow emulsion layer and "triple coated" red recording layer units containing fast, intermediate (a.k.a., mid) and slow speed emulsion layers. Typically in double coated arrangements the minimum speed difference between two emulsion layers is at least one stop (0.3 log E) and often range up to three stops (0.9 log E). In triple coated arrangements slow to mid and mid to fast speed differences are in these ranges.

In addition to the emulsion layers, the red recording layer unit contains a red reflective layer. Typical arrangements include the following:

| |
|---|
| Fast Latent Image Forming Layer<br>Reflective Layer<br>Slow Latent Image Forming Layer<br>(II) |
| Fast Latent Image Forming Layer<br>Mid Latent Image Forming Layer<br>Reflective Layer<br>Slow Latent Image Forming Layer<br>(III) |
| Fast Latent Image Forming Layer<br>Reflective Layer<br>Mid Latent Image Forming Layer<br>Slow Latent Image Forming Layer<br>(IV) |

The reflective layer contains 3-D grains meaning they have an aspect ratio less than 5. To perform a red light reflecting function the tabular imaging grains can take any of the silver halide compositions described above for the image recording layer units. Additionally, the silver halide grains in the reflective layer are substantially free of any red absorbing dye, notably any red absorbing spectral sensitizing dye.

To facilitate red light reflection, the red light reflective layer contains silver halide grains having a mean grain size in the range of from 0.10 to 0.80 $\mu$m, preferably 0.20 to 0.60 $\mu$m. Throughout this thickness range the grains reflect red light efficiently and, depending upon the exact size chosen, have the capability of reflecting blue and/or green light. However, blue and/or green light reflection is reduced by light of these wavelengths being absorbed in the overlying blue recording layer unit, blue filter layer (commonly employed), and the green recording layer unit. Although it would seem advantageous to select the grains to maximize red light reflection as opposed to blue and/or green light reflection, the fact is that the less efficient red light reflection per grain exhibited by the emulsion grains toward the lower end of the size range, may at any given coating coverage level, be compensated for by the larger number of emulsion grains. For example, at a fixed silver coating coverage, eight grains having a size of 0.25 μm can be substituted for each grain having a size of 0.50 μm. While each of the 0.25 μm grains does not reflect red light as efficiently as one 0.50 μm grain, the eight to one ratio at a fixed coating coverage compensates for differences in efficiencies. Reflective grain coating coverages in the range of from 0.4 to 1.25 g/m$^2$, based on silver, are contemplated.

It is possible to employ in the reflective layer high bromide grains in the selected size range that are present with silver halide grains that are tabular or are non-tabular but exhibit size outside the selected range. For example, it is possible to incorporate in the reflective layer a high bromide silver halide emulsion in which the grains in the selected range are precipitated along with other grains. The presence of grains outside the selected size range increase total silver coverages and reduce the overall efficiency of the reflective layer. It is therefore preferred to minimize the presence of grains outside the selected size range. Preferably the grains in the selected size range account for greater than 70 percent of total grain projected area and most preferably greater than 90 percent of total grain projected area in the reflective layer.

The silver halide grains in the red light reflective layer are substantially free of dye that absorbs red light, since this would interfere with red light reflection. Thus, the grains in the reflective layer are desirably free of adsorbed red absorbing spectral sensitizing dye. This precludes the red light reflective layer from significantly participating in latent image formation within the red recording layer unit. The grains in the reflective layer can be chemically sensitized or free of intentional chemical sensitization, since, in the absence of spectral sensitization, the grains in either form do not participate in latent image formation. For the same reason it is also possible to locate image dye forming compound in the reflective layer, but preferably no image dye forming compound is present. Oxidized developer scavenging compounds which do not form image dyes can also be used in the reflective layer, if desired.

When two or more silver halide emulsion layers relied upon for latent image formation and of differing speed are incorporated within a single dye image recording layer unit, they are generally chose to differ in speed by at least 0.3 log E. Speed differences of up to 0.9 log E are contemplated.

The remaining features of the color photographic element (I) can take any convenient conventional form. In addition to the silver halide grains and image dye-forming coupler, the blue, green and red recording layer units as well as all other processing solution permeable layers of the color photographic elements, such as the protective overcoat and the antihalation layer unit shown in element (I), contain processing solution permeable vehicle, typically hydrophilic colloid, such as gelatin or a gelatin derivative, as well as vehicle extenders and hardener, examples of which are listed in *Research Disclosure*, Item 38957, II. Vehicles, vehicle extenders, vehicle-like addenda and vehicle related addenda. The layers containing latent image forming silver halide grains additionally usually contain antifoggants and/or stabilizers, such as those listed *Research Disclosure*, Item 38957, VII. Antifoggants and stabilizers. The dye image forming layers can contain in addition to the dye image-forming couplers other dye image enhancing addenda, such as image dye modifiers, hue modifiers and/or stabilizers, and solvents for dispersing couplers and related hydrophobic addenda, summarized in X. Dye image formers and modifiers, sections C, D and E. Colored dye-forming couplers, such as masking couplers, are commonly incorporated in negative-working photographic films, as illustrated in *Research Disclosure*, Item 38957, XII. Features applicable only to color negative.

The antihalation layer unit shown in element (I) is not essential, but is highly preferred to improve image sharpness. The antihalation layer unit can be coated between the red recording layer unit and the transparent film support or, alternatively, coated on the back side of the transparent film support. In addition to vehicle to facilitate coating the antihalation layer unit contains light absorbing materials, typically dyes, chosen to be decolorized (discharged) on processing, a summary of which is provided in *Research Disclosure*, Item 38957, VIII. Absorbing and scattering materials, B. Absorbing materials and C. Discharge.

The protective overcoat is not essential, but is highly preferred to provide physical protection to the blue recording layer In its simplest form the protective overcoat can consist of a single layer containing a hydrophilic vehicle of the type described above. The protective overcoat is a convenient location for including coating aids, plasticizers and lubricants, antistats and matting agents, a summary of which is provided in *Research Disclosure*, Item 38957, IX. Coating and physical property modifying addenda. Additionally, ultraviolet absorbers are often located in the protective overcoat, illustrated in *Research Disclosure*, Item 38957, UV dyes/optical brighteners/luminescent dyes. Often the protective overcoat is divided into two layers with the above addenda being distributed between these layers. It is also common practice to place a layer similar to the protective overcoat in the back side of the support containing surface property modifying addenda. When an antihalation layer is coated on the back side of the support, surface modifying addenda are usually incorporated in this layer.

To avoid color contamination of the blue, green and red recording layer units, it is conventional practice to incorporate a oxidized developing agent scavenger (a.k.a. antistain agent) in the layer units to prevent migration of oxidized color developing agent from one layer unit to the next adjacent layer unit. Preferably the oxidized color developing agent is located in a separate layer, not shown in (I) above, at the interface of the layer units. Antistain agents are summarized in *Research Disclosure*, Item 38957, D. Hue modifiers/stabilization, paragraph (2).

It is also preferred to locate a blue filter material, such as a processing solution decolorizable yellow dye or Carey Lea silver, in a layer between the latent image forming grains in the blue recording layer unit and the next adjacent layer unit. These filter materials are also disclosed in *Research Disclosure*, Item 38957, VIII. Absorbing and scattering materials, B. Absorbing materials and C. Discharge.

The transparent film support can take any convenient conventional form. The film support is generally understood to include subbing layers placed on the film to improve the adhesion of hydrophilic colloid layers. Conventional transparent film support characteristics are summarized in *Research Disclosure*, Item 38957, XV. Supports (2), (3), (4), (7), (8) and (9).

When the color photographic films are intended to be scanned, either for image retrieval or for retrieving information incorporated during manufacture for aiding exposure or processing, they can contain features such as those illustrated by *Research Disclosure*, Item 38957, XIV. Scan facilitating features. When a magnetic recording layer is incorporated in the color film, it is preferably located on the back side of the film support.

The color films of invention are specifically contemplated for use in cameras used to capture visible light images of photographic subjects. Exposures can range from high intensity, short duration exposures to low intensity, long duration exposures. Since the present invention offers the capability of increasing red speeds, shorter exposures at lower lighting intensities are specifically contemplated. For example, the present invention is particularly suited for producing color films having ISO ratings higher than 200, preferably higher than 400 and optimally higher than 1000. The color films can be employed in cameras intended for repeated use or only limited use (e.g., single-use) cameras. Contemplated features of limited use cameras are disclosed in *Research Disclosure*, Item 38957, XVI. Exposure, (2).

Once imagewise exposed, the color photographic films of the invention can be processed in any convenient conventional manner to produce dye images that correspond to the latent images in the recording layer units or that are reversals of the latent images. Most commonly, negative-working emulsions are incorporated in the recording layer units which produce a color negative dye image when subjected to a single color development step. If direct-positive emulsions are substituted in the recording layer units, a single color development step produces a positive dye image—i.e., a reproduction of the subject photographed. When negative-working emulsions are incorporated in the recording layer units, reversal processing (black-and-white development followed by color development), is capable of producing a positive dye image. Illustrations of conventional color processing systems are provided by *Research Disclosure*, Item 38957, XVIII. Chemical development systems, B. Color-specific processing systems.

A specifically preferred processing system is the Kodak Flexicolor™C-41 color negative process. It is specifically contemplated to introduce modifications to the color film and the process to permit development times of less than 2 minutes with improved results, as illustrated by Becher et al U.S. Ser. No. 09/014,842, filed Jan. 28, 1998; U.S. Ser. No. 09/015,720, filed Jan. 29, 1998; and U.S. Ser. No. 09/024,335, filed Feb. 17, 1998; each commonly assigned and currently allowed, here incorporated by reference.

EXAMPLES

The invention can be better appreciated by reference to the following specific embodiments. Component coating coverages are reported in units of g/m$^2$. Multilayer films in varied formats (ML-A, ML-B, and ML-C) demonstrating the principles of this invention were produced by coating the following layers on a cellulose triacetate film support (emulsion sizes are determined by the disc centrifuge method and are reported in Diameter x Thickness in micrometers). Antifoggants (including 4-hydroxy-6-methyl-1,3,3a,7-tetraazaindene), surfactants, coating aids, emulsion addenda, sequestrants, thickeners, lubricants, matte and tinting dyes were added to the appropriate layers as is common in the art.

Formulas for the identified compounds are provided at the end of all of the examples.

Samples of each multilayer element were given a neutral 5500K stepped exposure and developed in a process described in *British Journal of Photography* 1982 *Annual*, pp 209 (which includes development using a p-phenylenediamine type compound). Speed or light sensitivity toward red light relative to a check position (e.g. ML-A-1) was determined by comparing the exposure at a point 0.15 density units above fog (Δ Red Toe Speed), or at a point 0.7 density units above fog (Δ Red Midscale Speed).

The visual sensation of non-uniformity in a developed photographic film, noise, is termed graininess, whereas an objective measure of noise is called granularity. Granularity of a red layer of a neutral exposure was determined by the RMS method (see *The Theory of Photographic Process,* 4$^{th}$ Edition, T. H. James, pp 618–628) using a 48 micron aperture at a red density of 0.45. RMS values are a measure of the standard deviation of density at various densities X 1000. When comparing the noise of photographic materials of different contrast (different slope of the density vs. exposure function), graininess relationships are better approximated by the ratio of RMS granularity and contrast (also called gamma-normalized-granularity or GNG) than by RMS granularity by itself. Lower GNG values indicate improved photographic performance. The % changes in Red GNG of neutral exposures were compared relative to the check (e.g. ML-C-1). Negative Δ% Red GNG values indicate a desirable improvement in photographic performance.

Sharpness differences are reported in terms of Red CMT (cascaded modulation transfer) units. The equations on which CMT is based are reported in James *The Theory of the Photographic Process,* 4th Ed., Macmillan, New York, 1977, p. 629, with a more qualitative explanation being provided by Keller *Science and Technology of Photography*, VCH, New York, 1993, under the topic Modulation Transfer Function, starting at page 175. Negative CMT differences indicate an undesirable loss of sharpness.

All results are given as differences relative to the "Control" case for each example.

Example 1

Sample ML-A-1

- Layer 1 (Protective Overcoat Layer): POL-1 at 0.108 as matte with gelatin at 0.883.
- Layer 2 (UV Filter Layer): silver bromide Lippmann emulsion at 0.108, UV-1 and UV-2 both at 0.108, RA-1 at 0.009 and gelatin at 0.700.
- Layer 3 (Fast Yellow Layer): a blue (BSD-1) sensitized silver iodobromide 3-D emulsion, 1.4 μm in diameter, 9.7 mole % I at 1.292, silver bromide Lippmann emulsion at 0.108, yellow dye forming coupler Y-1 at 0.484, Soluble Mercaptide Agent Releasing Coupler SMARC-1 at 0.004, and gelatin at 1.70.
- Layer 4 (Slow Yellow Layer): a blend of three blue (BSD-1+BSD-2) sensitized tabular silver iodobromide emulsions: (i) 2.15×0.143 μm, 2.0 mole % I at 0.269, (ii) 0.98×0.133 μm, 2.0 mole % I at 0.269 and (iii) 0.6×0.115 μm, 3 mole % I at 0.323, silver bromide Lippmann emulsion at 0.108, yellow dye forming coupler Y-1 at 0.566, IR-6 at 0.019, SMARC-1 at 0.004 and gelatin at 1.70
- Layer 5 (Top Interlayer): OxDS-1 at 0.075, X at 0.043 and gelatin at 0.538.
- Layer 6 (Fast Magenta Layer): a blend of two green sensitized (with a mixture of GSD-1 and GSD-2) silver iodobromide tabular emulsions: (i) 2.76×0.127 μm, 3.7 mole % I at 0.823 and (ii) 2.19×0.120 μm, 3.7 mole % I at 0.353, magenta dye forming coupler M-1 at 0.090, masking coupler MM-1 at 0.022, IR-7 at 0.003, IR-2 at 0.011, OxDS-1 at 0.012, X at 0.006 and gelatin at 1.43.
- Layer 7 (Mid Magenta Layer): a blend of two green sensitized (both with a mixture of GSD-1 and GSD-2) silver iodobromide tabular emulsions: (i) 1.45×0.12 μm, 3.7 mole % I at 0.250 and (ii) 1.0×0.13 μm, 4.5 mole % I at 0.181, magenta dye forming coupler M-1 at 0.075, masking coupler MM-1 at 0.065, IR-2 at 0.016, OxDS-1 at 0010, X at 0.005 and gelatin at 1.45.
- Layer 8 (Slow magenta layer): a green sensitized (with a mixture of GSD-1 and GSD-2) silver iodobromide tabular emulsion, 0.6×0.115 μm, 3 mole % I at 0.548, magenta dye forming coupler M-1 at 0.258, masking coupler MM-1 at 0.069, IR-2 at 0.022, OXDS-1 at 0.011 and gelatin at 1.20.

Layer 9 (Bottom Interlayer): OxDS-1 at 0.075 and gelatin at 0.538.

Layer 10 (Fast Cyan layer): a red-sensitized (with a mixture of RSD-1, RSD-3, and RSD-2) silver iodobromide tabular emulsion (3.64×0.12 μm, 3.7 mole % I) at 1.13, cyan dye-forming coupler C-2 at 0.228, IR-4 at 0.032, IR-3 at 0.022, OxDS-1 at 0.014 and gelatin at 1.24.

Layer 11 (Cyan Reflector Layer): gelatin at 0.66.

Layer 12 (Mid Cyan Layer): a blend of two red-sensitized (both with a mixture of RSD-1, RSD-3 and RSD-2) silver iodobromide tabular emulsions: (i) 2.25×0.12 μm, 3.7 mole % I at 0.915 and (ii) 1.31×0.125 μm, 3.7 mole % I at 0.161, cyan dye-forming coupler C-1 at 0.215, C-2 at 0.075, IR-5 at 0.060, masking coupler CM-1 at 0.022, Soluble Mercaptide Agent Releasing Coupler SMARC-1 at 0.013, and gelatin at 1.55.

Layer 13 (Slow Cyan Layer): a blend of two red sensitized (both with a mixture of RSD-1, RSD-3 and RSD-2) silver iodobromide tabular emulsions: (i) 0.77×0.10 μm, 4.5 mole % I at 0.108 and (ii) 0.6×0.1 15 μm, 3.0 mole % I at 0.861, cyan dye-forming coupler C-1 at 0.334, C-2 at 0.194, IR-6 at 0.032, SMARC-1 at 0.086, OxDS-2 at 0.006, and gelatin at 1.51.

Layer 14 (Antihalation layer): Black Colloidal Silver at 0.135, UV-1 and UV-2 both at 0.075, OxDS-1 at 0.097, X at 0.043 and gelatin at 1.61.

Hardener: (Bisvinylsulfonyl)methane at 1.55% of total gelatin weight.

Sample ML-A-2

Like sample ML-A-1 except the following layer was changed:

Layer 11 (Cyan Reflector Layer): an unsensitized reflecting material (0.40 μm 3-D iodobromide emulsion, 3% mole % iodide) at 0.861 was added to this layer.

Sample ML-A-3

Like sample ML-A-1 except the following layer was changed:

Layer 10 (Fast Cyan Layer): the 3.64×0.12 μm red-sensitized emulsion was substituted by an equal amount (1.13) of a larger, equally sensitized, silver iodobromide tabular emulsion (5.8×0.12 μm, 3.7 mole % I).

Sample ML-A-4

Like sample ML-A-1 except the following layer was changed:

Layer 11 (Cyan Reflector Layer): a tabular unsensitized reflecting material (5.92×0.072 μm bromide emulsion) at 0.861 was added to this layer.

Results from testing of multilayers ML-A-1 through 4 are shown in Table I.

TABLE I

ML-A Results

| Sample ML-A | Type | Feature | Δ Red Toe Speed (logE) | Δ % Red GNG at D = 0.45 | Δ Red CMT |
|---|---|---|---|---|---|
| A-1 | Comp | Control | check | check | Check |
| A-2 | Inv | A-1 + Inventive 3-D Reflecting Material in Layer #11 | 0.08 | 3 | +0.30 |
| A-3 | Comp | A-1 Except larger emulsion used in Layer #10 | 0.08 | 20 | −0.20 |
| A-4 | Comp | B-1 + Tabular Reflecting Non-spectrally sensitized Material in Layer #11 | 0.12 | 6 | −0.40 |

The results in Table I from multilayer format ML-A show that the present invention is far superior to the most commonly employed strategy to obtain higher light sensitivity (photographic speed), that is to increase the size, and therefore the absorption cross-section, of the fastest sensitized emulsion for the color record of interest.

Addition of the reflecting material to the cyan reflector layer (layer 11) (Sample A-2) of the control resulted in increased photographic sensitivity (speed) of the red of a neutral exposure by about 0.08 logE, with minimal losses in graininess and sharpness improvement. Indeed, an increase of 3% in (granularity/contrast) at $D_{red}$=0.45 is well below the threshold for visible differences. By comparison, the increase in sensitized emulsion size needed to obtain the same speed increase relative to the check (also about 0.08 loge) leads e to a much larger degradation of both graininess and degradation of sharpness as well, specifically an increase in gamma-normalized-granularity of 20% at $D_{red}$= 0.45 and a 0.2 CMT units loss in acutance.

Addition of a tabular reflecting material to the cyan reflector layer (layer 11) (Sample A-4) also resulted in increased photographic sensitivity but with a significant loss in both graininess and sharpness.

Example 2

Sample ML-B-1

Layer 1 (Protective Overcoat Layer): POL-1 at 0.108 as matte with gelatin at 0.888.

Layer 2 (UV Filter Layer): silver bromide Lippmann emulsion at 0.107, UV-1 and UV-2 both at 0.108 and gelatin at 0.700.

Layer 3 (Fast Yellow Layer): a blend of two blue sensitized silver iodobromide emulsions: (i) a large tabular emulsion (BSD-1 and BSD-2), 4.21×0.131 μm, 2.0 mole % I at 0.332 and (ii) a 3-D emulsion. 1.2 μm diameter (BSD-1), 9.7 mole % I at 0.900, silver bromide Lippmann emulsion at 0.135, Y-1 at 0.400, IR-1 at 0.065, SMARC-1 at 0.008, RA-1 at 0.009, and gelatin at 1.70.

Layer 4 (Slow Yellow Layer): a blend of three blue (BSD-1+BSD-2) sensitized tabular silver iodobromide emulsions: (i) 1.25×0.1 μm, 2.0 mole % I at 0.360, (ii) 0.77×0.14 μm, 2.0 mole % I at 0.386 and (iii) 0.82×0.12 μm, 3.0 mole % I at 0.357, silver bromide Lippmann emulsion at 0.135, yellow dye forming coupler Y-1 at 0.725, IR-1 at 0.038, IR-6 at 0.022, SMARC-1 at 0.008 and gelatin at 1.70

Layer 5 (Top Interlayer): OxDS-1 at 0.182, X at 0.054 and gelatin at 0.538.

Layer 6 (Fast Magenta Layer): a green sensitized (with a mixture of GSD-1 and GSD-2) silver iodobromide tabular emulsions (2.76×0.13 μm, 3.7 mole % iodide) at 1.076, magenta dye forming coupler M-1 at 0.082, masking coupler MM-1 at 0.022, IR-7 at 0.003, IR-2 at 0.011, X at 0.011, OxDS-1 at 0.012 and gelatin at 1.42.

Layer 7 (Mid Magenta Layer): a blend of two green sensitized (both with a mixture of GSD-1 and GSD-2) silver iodobromide tabular emulsions: (i) 2.19×0.12 μm, 3.7 mole % iodide at 0.269 and (ii) 1.45×0.12 μm, 3.7 mole % iodide at 0.465, magenta dye forming coupler M-1 at 0.086, Masking Coupler MM-1 at 0.086, IR-2 at 0.016, X at 0.011, OxDS-1 at 0 012 and gelatin at 1.45.

Layer 8 (Slow magenta layer): a blend of two green sensitized (both with a mixture of GSD-1 and GSD-2) silver iodobromide tabular emulsions: (i) 1.0×0.12 μm, 4.5 mole % iodide at 0.161 and (ii) 0.5×0.13 μm, 2.6 mole % iodide at 0.323, magenta dye forming coupler M-1 at 0.215, Masking Coupler MM-1 at 0.047, IR-2 at 0.032, OxDS-1 at 0.011 and gelatin at 1.21.

Layer 9 (Bottom Interlayer): OxDS-1 at 0.182 and gelatin at 0.538.

Layer 10 (Fast Cyan layer): a red-sensitized (with a mixture of RSD-1, RSD-3, and RSD-2) silver iodobromide tabular emulsion (3.64×0.12 μm, 3.7 mole % I) at 1.27, cyan dye-forming coupler C-2 at 0.228, IR-4 at 0.032, IR-3 at 0.022, OxDS-1 at 0.014 and gelatin at 1.24.

Layer 11 (Cyan Reflector Layer): this layer omitted

Layer 12 (Mid Cyan Layer): a blend of two red sensitized (both with a mixture of RSD-1, RSD-3, and RSD-2) silver iodobromide tabular emulsions: (i) a large sized iodobromide tabular grain emulsion (2.25×0.12 μm, 3.7 mole % I) at 0.716, (ii) a smaller iodobromide tabular emulsion (1.31×0.125 μm, 3.7 mole % I) at 0.452, cyan dye-forming coupler C-1 at 0.307, C-2 at 0.075, IR-5 at 0.060, Soluble Mercaptide Agent Releasing Coupler SMARC-1 at 0.013, masking coupler CM-1 at 0.022 and gelatin at 1.55.

Layer 13 (Slow Cyan Layer): a blend of two red sensitized (both with a mixture of RSD-1 and RSD-3) silver iodobromide emulsions: (i) a large sized iodobromide tabular grain emulsion (0.8×0.10 μm, 4.5 mole % I) at 0.330, (ii) a smaller iodobromide tabular emulsion (.0.5×0.13 μm, 3.0 mole % iodide) at 0.270, cyan dye-forming coupler C-1 at 0.291, C-2 at 0.194, IR-6 at 0.032, Soluble Mercaptide Agent Releasing Coupler SMARC-1 at 0.086, OxDS-2 at 0.006, and gelatin at 1.51.

Layer 14 (Antihalation layer): Black Colloidal Silver at 0.135, UV-1 and UV-2 both at 0.075, OxDS-1 at 0.097, X at 0.043 and gelatin at 1.61.

Hardener: (Bisvinylsulfonyl)methane at 1.75% of total gelatin weight.

Sample ML-B-2

Like sample ML-D-1 except the following layer was changed:

Layer 11 (Cyan Reflector Layer): an unsensitized reflecting material (0.32 μm 3-D iodobromide emulsion, 3% mole % iodide) at 0.861, OxDS-1 at 0.032 and gelatin at 0.66 were added to this layer.

Sample ML-B-3

Like sample ML-D-1 except the following layers were changed:

Layer 10 (Fast Cyan Layer): C-2 was changed to 196

Layer 11 (Cyan Reflector Layer): a red-sensitized (with a mixture of RSD-1, RSD-3, and RSD-2) silver iodobromide tabular emulsion (2.25×0.12 μm, 3.7 mole % I) at 1.022, cyan dye-forming coupler C-1 at 0.198, C-2 at 0.006, IR-5 at 0.043, Soluble Mercaptide Agent Releasing Coupler SMARC-1 at 0.008 and gelatin at 1.13 were added to this layer.

Layer 12 (Mid Cyan Layer): the larger of the two red sensitized silver iodobromide tabular emulsions was omitted, the smaller one was coated at 0.650, C-1 at 0.240, C-2 at 0.100, IR-5 at 0.043, CM-1 at 0.022, SMARC-1 at 0.011 and gelatin at 1.079.

Results from testing of multilayers ML-B-1 through 3 are shown in Table II.

TABLE II

ML-B Results

| Sample ML-B | Type | Feature | Δ Red Toe Speed (logE) | Δ % Red GNG at D = 0.45 | Δ Red CMT |
|---|---|---|---|---|---|
| B-1 | Comp | Control | check | check | check |
| B-2 | Inv | D-1 + 3-D Reflecting Material in Layer #11 | 0.11 | −3 | 0 |
| B-3 | Comp | D-1 + Spectrally Sensitized Tabular Material in Layer #11 | −0.02 | −7 | −0.05 |

The results in Table II from multilayer format ML-B show how the present invention is superior to the alternative of placing spectrally sensitized, image-forming emulsions rather than non-spectrally sensitized reflecting 3-D emulsions in the reflector layer.

Addition of a cyan reflector layer (layer 11, Sample B-2), containing the 3-D reflecting material, to the control increased the red toe speed by 0.11 logE, also causing a slight improvement in red GNG of 3% at constant sharpness. The comparison Sample B-3, in which the reflecting material is substituted by a quantity of red-light sensitive emulsions and image coupler sufficient to achieve the same photographic contrast as in samples B-1 and B-2, affords only a speed similar to that of the control, along with a slight improvement in GNG and a slight degradation in sharpness.

Example 3

Sample ML-C-1

Layer 1 (Protective Overcoat Layer): gelatin at (0.871).

Layer 2 (UV Filter Layer): silver bromide Lippmann emulsion at (0.215), UV-1 at (0.022) and UV-2 at (0.114) and gelatin at (0.860).

Layer 3 (Fast Yellow Layer): a blue sensitized (with BSD-1) silver iodobromide nontabular emulsion, 2 μm ECD, 9 mole % I, based on total Ag, at (1.72), YC-1 at (0.088), YC-2 at (0.234) and gelatin at (2.0).

Layer 3B (reflector layer) omitted.

Layer 4 (Slow Yellow Layer): a blend of two blue sensitized (all with BSD-1) tabular grain silver iodobromide emulsions (i) 2.7 μm ECD×0.13 μm t, 3.3 mole % I, based on total Ag, at (0.484) and (ii) 1.6 μm ECD×0.13 μm t, 1.3 mole % I, based on total Ag, at (0.323), yellow dye forming coupler YC-1 at (0.464), YC-2 at (0.099), IR-1 at (0.042) and gelatin at (1.58).

Layer 5 (Yellow filter layer): YFD-1 at (0.151), YFD-2 at (0.043), OxDS-3 at (0.108) and gelatin at (0.645).

Layer 6 (Fast Magenta Layer): a green sensitized (with a mixture of GSD-1 and GSD-2) silver iodobromide tabular grain silver iodobromide emulsions 3.4 μm ECD×0.11 μm t, 4 mole % iodide, based on Ag, at (1.032), magenta dye forming coupler M-1 at (0.088), MC-2 at (0.011), MC-3 at (0.003), Masking Coupler MM-1 at (0.022) and gelatin at (1.25).

Layer 7 (Mid Magenta Layer): a green sensitized (with a mixture of GSD-1 and GSD-2) silver iodobromide tabular grain emulsions: (i) 1.2 μm ECD×0.14 μm t, 4.5 mole % iodide, based on Ag, at (1.28), magenta dye forming coupler MC-2 at (0.074), MC-3 at (0.022), MC-4 at (0.106), masking coupler MM-1 at (0.048), IR-7 at (0.010) and gelatin at (1.42).

Layer 8 (Slow magenta layer): a green sensitized (with a mixture of GSD-1 and GSD-2) silver iodobromide tabular grain emulsion: (i) 0.7 μm ECD×0.14 μm t, 0.3 mole % iodide, based on Ag, at (0.484), magenta dye forming coupler MC-2 at (0.069), MC-3 at (0.21), MC-4 at (0.099), Masking Coupler MM-1 at (0.086) and gelatin at (0.914).

Layer 9 (Interlayer): OxDS-3 at (0.110) and gelatin at (1.08).

Layer 10 (Fast Cyan layer): a blend of two red sensitized (with a mixture of RSD-1 and RSD-2) silver iodobromide tabular grain emulsions: (i) 3.0 μm ECD×0.12 μm t, 4.0 mole % I, based on Ag, at (0.634), (ii) 1.31 μm ECD×0.14 μm t, 4.5 mole % I, based on Ag, at (0.333), cyan dye-forming coupler C-1 at (0.060), yellow dye-forming coupler YC-2 at (0.022), masking coupler CM-1 at (0.027), bleach accelerator releasing coupler B-1 at (0.044) and gelatin at (0.882).

Layer 11 (Slow cyan layer): a blend of two red sensitized (all with a mixture of RSD-1 and RSD-2) silver iodobromide tabular grain emulsions: (i) 1.3 μm ECD×0.14 μm t, 4.5 mole % I, based on Ag, at (0.950) and (ii) 1.0 μm ECD×0.11 μm t, 3.5 mole % I, based on Ag, at (0.674), cyan dye-forming coupler C-1 at (0.409), yellow dye-forming coupler YC-2 at (0.022), masking coupler CM-1 at (0.011), bleach accelerator releasing coupler B-1 at (0.065), IR-6 at (0.017), IR-9 at (0.026) and gelatin at (1.72).

Sample ML-C-2

Identical to ML-C-1 except that layer 3b contained a non light-sensitive silver halide emulsion, free of absorbing dye, having an average size of 0.22 um at 0.861 g/m$^2$ and gelatin at 1.08 g/m$^2$.

Sample ML-C-3

Identical to ML-C-1 except that layer 3b contained a non light-sensitive silver halide emulsion, free of absorbing dye, having an average size of 0.32 um at 0.861 g/m$^2$ and gelatin at 1.08 g/m$^2$.

Results from testing of multilayers ML-C-1 through 3 are shown in Table III.

TABLE III

ML-C Results

| Sample ML-C | Type | Feature | Δ Blue Toe Speed (logE) | Δ % Red GNG at D = 0.45 | Δ Red CMT |
|---|---|---|---|---|---|
| C-1 | Comp | Control | check | check | check |
| C-2 | Comp | 0.22 μm 3-D reflecting emulsion in Layer 3b | 0.08 | 0 | −1.9 |
| C-3 | Comp | 0.32 μm 3-D reflecting emulsion in Layer 3b | 0.08 | 0 | −2.1 |

The data of Table 5 demonstrate that placing a light reflecting addenda below the fast yellow emulsion of a multilayer film element, while increasing the speed slightly, results in a very high degradation of sharpness in the red record. These data, when considered with the results of Examples 1 and 2, indicate that the successful method of practice of the invention comprised the 3-D reflector layer, free of red absorbing dye, located below and only below the most red light sensitive layer of the red record.

Chemical Structures

B-1

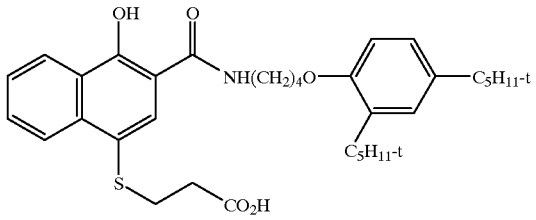

BSD-1

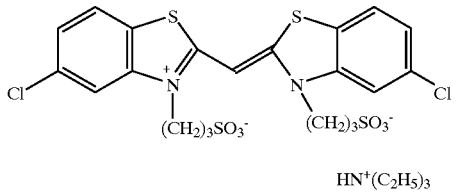

BSD-2

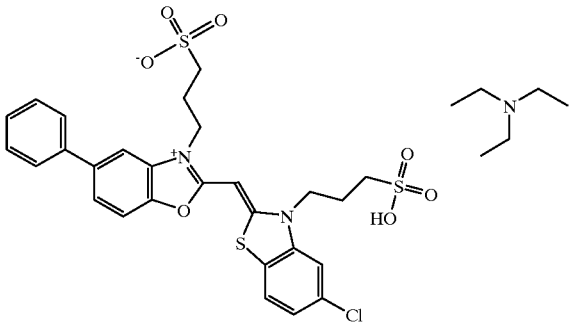

-continued
C-1
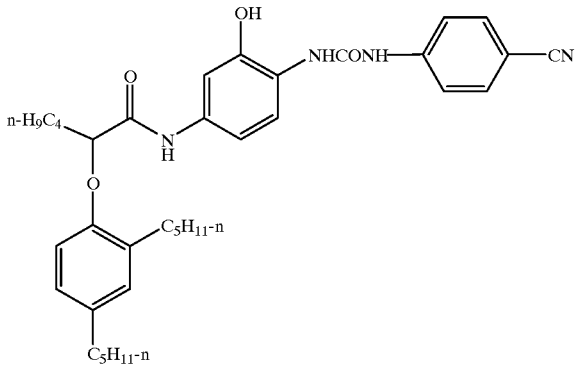
C-2
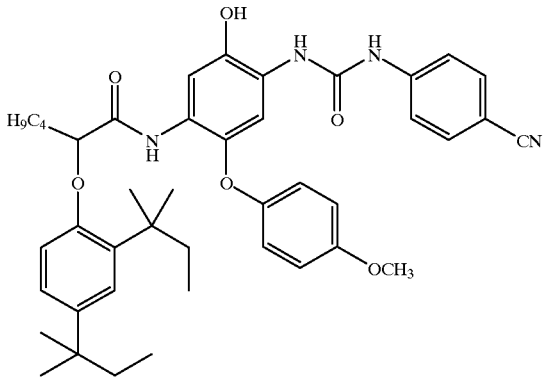
CM-1
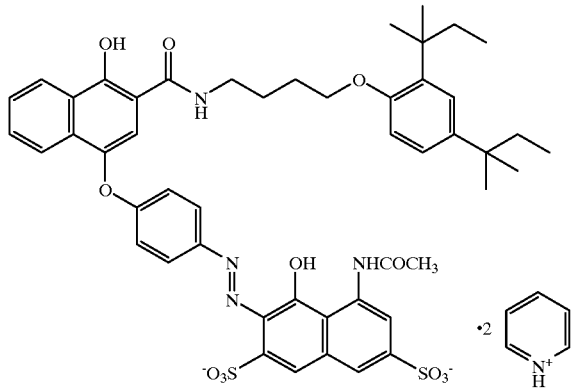
-continued
CSC-1
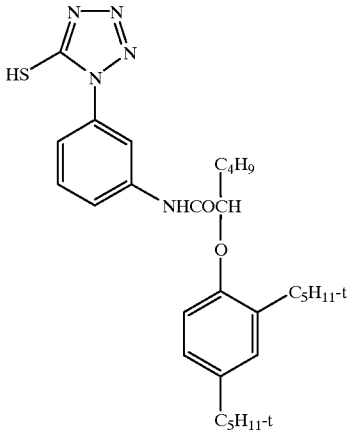
ETARC-1
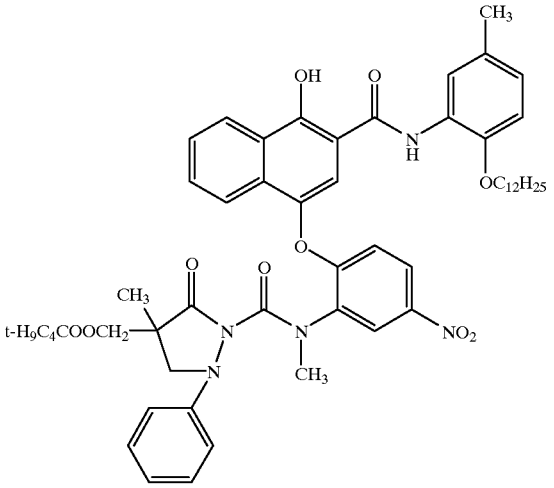
GSD-1
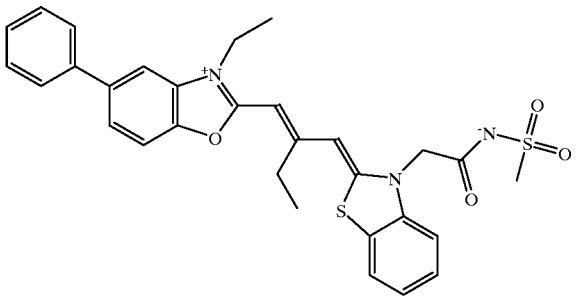
GSD-2
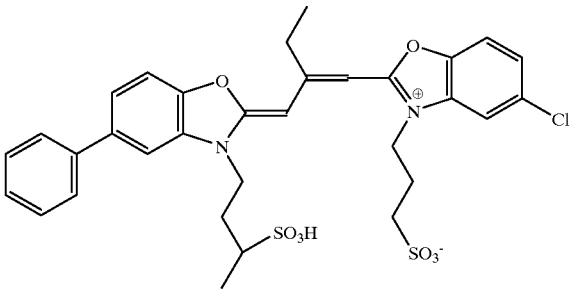

-continued
IR-1
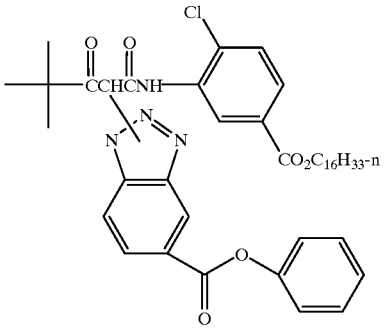
IR-2
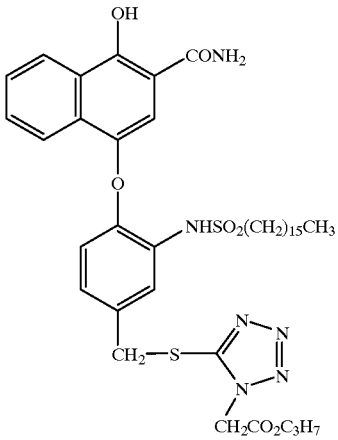
IR-3
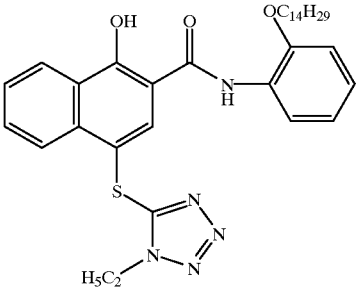
IR-4
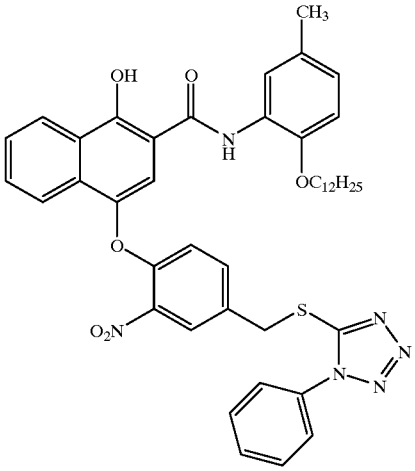
-continued
IR-5
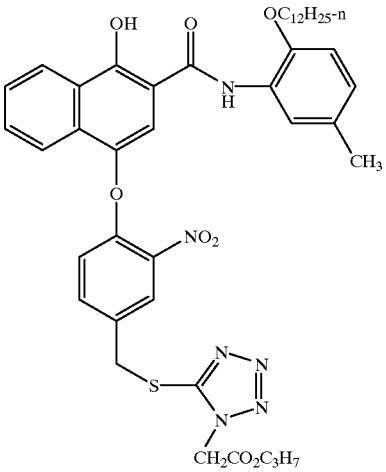
IR-6
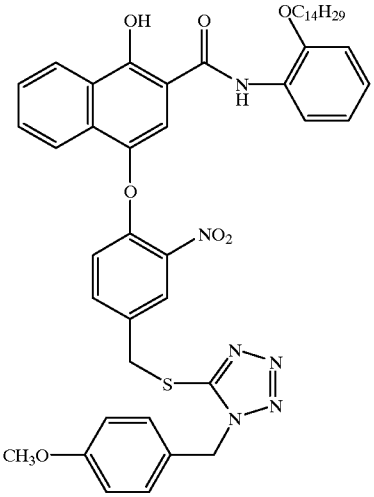
IR-7
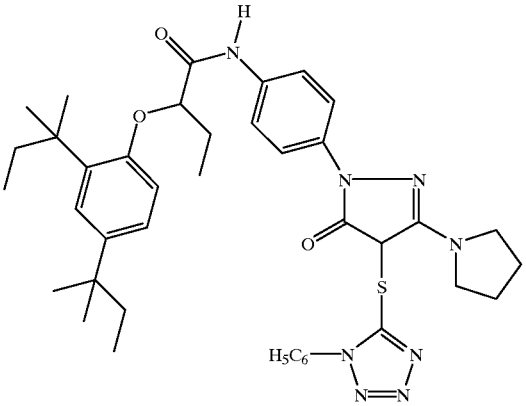

-continued
IR-8
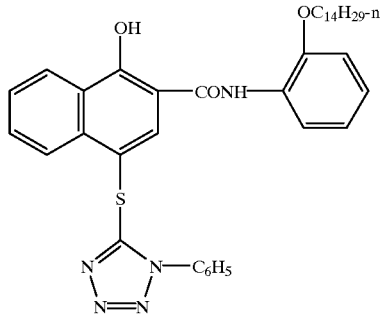
IR-9
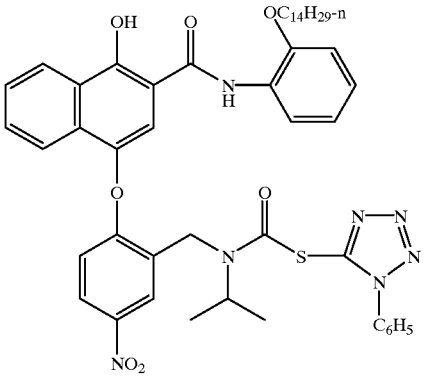
M-1
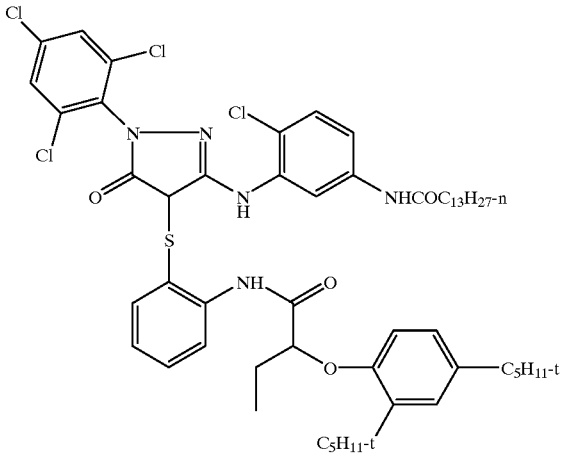
MC-2
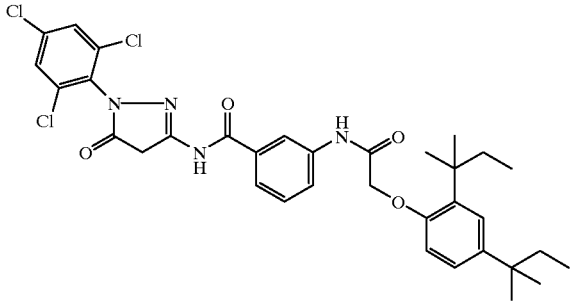
-continued
MC-3
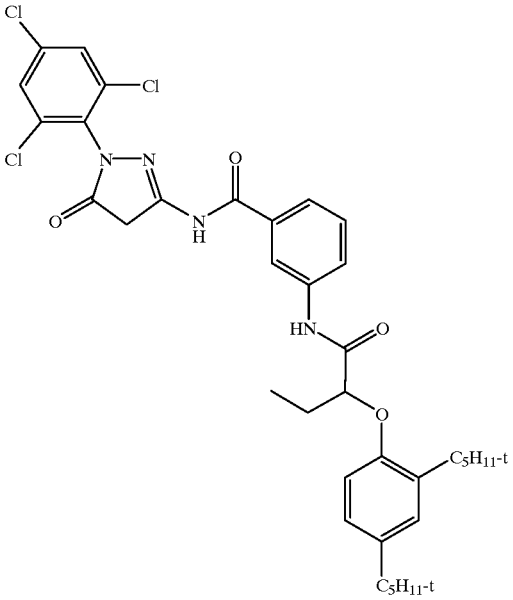
MC-4
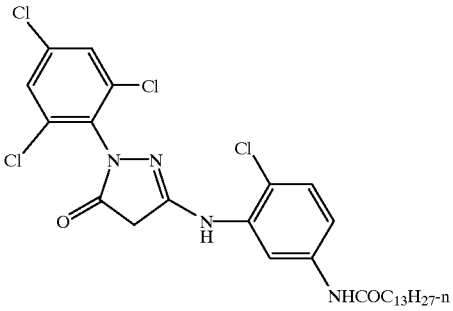
MM-1
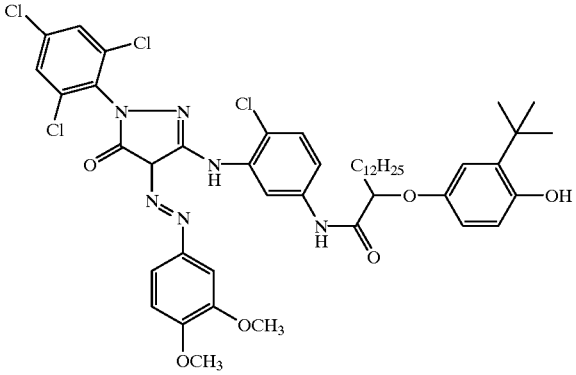
OxDS-1
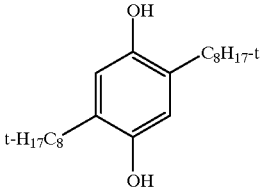

-continued
OxDS-2
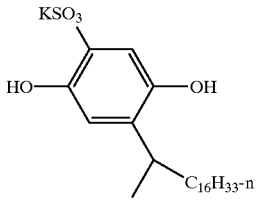
OxDS-3
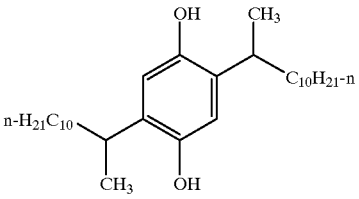
POL-1
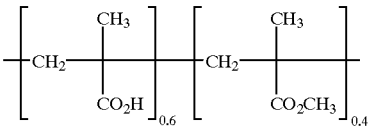
RA-1
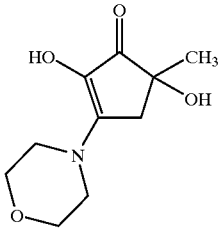
RSD-1
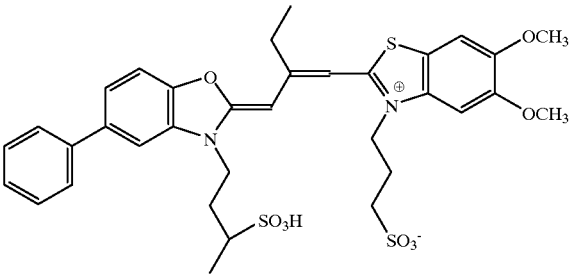
RSD-2
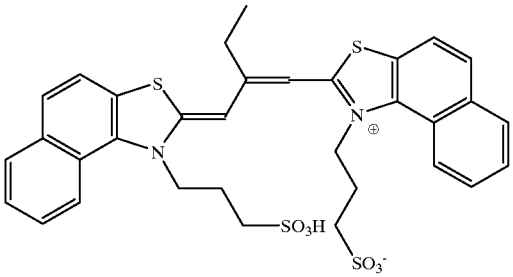
-continued
RSD-3
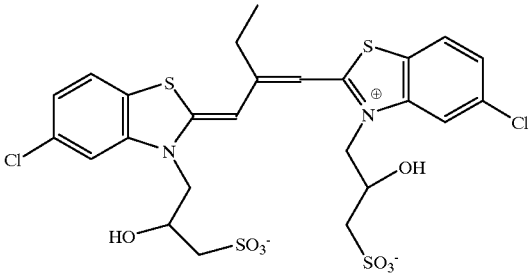
SMARC-1
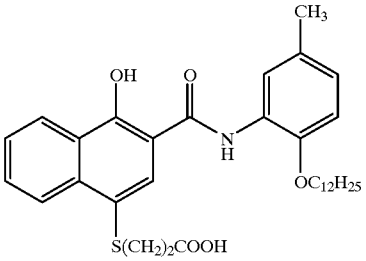
UV-1
UV-2
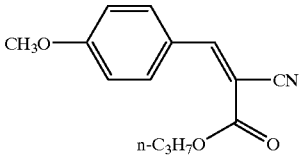
Y-1
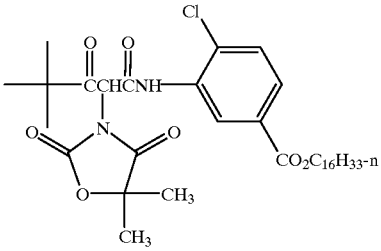
YC-1
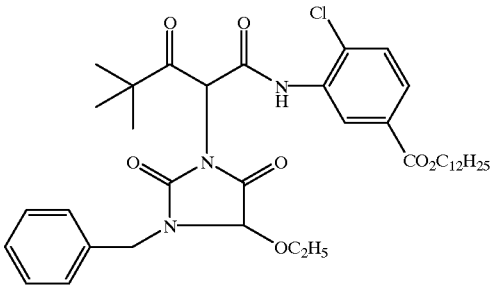

-continued

YC-2

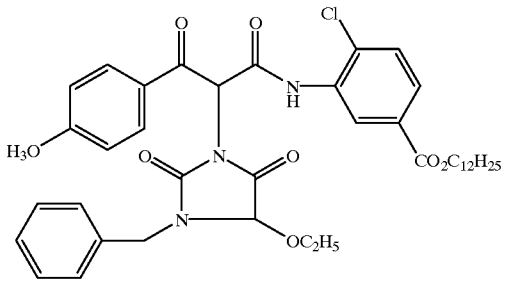

YFD-1

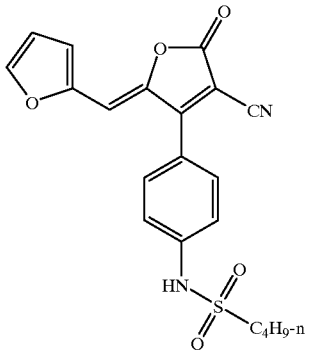

YFD-2

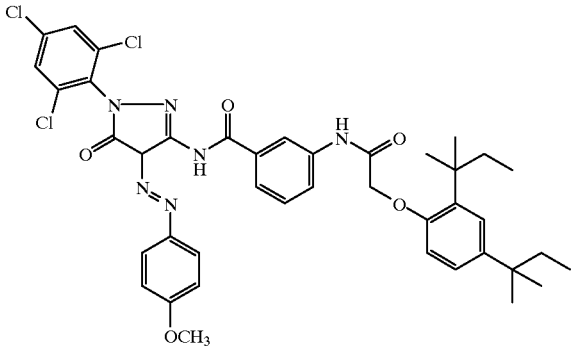

The invention has been described in detail with particular reference to preferred embodiments thereof, but it will be understood that variations and modifications can be effected within the scope and spirit of the invention.

What is claimed is:

1. A color photographic element containing a support bearing:

(a) a red record comprising, in order from the support, a less and a more red light sensitive silver halide emulsion layer, each having associated therewith at least one cyan dye-forming coupler;

(b) further from the support a green record comprising, in order from the support, a less and a more green light sensitive silver halide emulsion layer, each having associated therewith at least one magenta dye-forming coupler, and (c) still further from the support, a blue record comprising in order from the support, a less and a more blue light sensitive silver halide emulsion layer, each having associated therewith at least one yellow dye-forming coupler;

wherein:

(d) there is located below and only below the most red light sensitive layer of the red record a relatively non-light sensitive "small 3-D emulsion layer" that is substantially free of red light absorbing dye.

2. A color photographic element according to claim 1 wherein the small 3-D emulsion layer contains greater than 50 mol % of grains having an ECD of 0.1 to 0.8 $\mu$m.

3. A color photographic element according to claim 2 wherein the 3-D grains in the red light reflective layer primarily have an ECD in the range of from 0.30 to 0.60 $\mu$m.

4. A color photographic element according to claim 1 wherein the silver halide grains in the red light reflective layer are present at a silver laydown from 0.4 to 1.25 g/m$^2$.

5. A color photographic element according to claim 4 wherein the silver halide grains in the red light reflective layer are present at a silver laydown from 0.6 to 1.00 g/m$^2$.

6. A color photographic element according to claim 1 wherein the silver halide grains in each of the layers contains greater than 90 mole percent bromide, based on silver.

7. A color photographic element according to claim 6 wherein the silver halide grains for forming a developable latent image are silver iodobromide grains.

8. A color photographic element according to claim 1 wherein the silver halide grains in the red light reflective layer are primarily silver bromide grains.

9. A color photographic element according to claim 1 wherein the red light reflective layer is contiguous to the most red light sensitive layer of the red record.

10. A color photographic element according to claim 1 wherein the red record is comprised of three layers of varying light sensitivity and the red light reflective layer is located between the most red light sensitive layer and the mid light sensitive layer of the red record.

11. A color photographic element according to claim 1 wherein the red record is comprised of three layers of varying light sensitivity and the red light reflective layer is located between the mid red light sensitive layer and the least light sensitive layer of the red record.

12. A color photographic element according to claim 1 wherein the red record is comprised of three layers of varying light sensitivity and the red light reflective layer is located below the least red light sensitive layer of the red record.

13. A color photographic element containing a support bearing (a) a red record comprising, in order from the support, a less and a more red light sensitive silver halide emulsion layer, each having associated therewith at least one cyan dye-forming coupler;

(b) further from the support a green record comprising, in order from the support, a less and a more green light sensitive silver halide emulsion layer, each having associated therewith at least one magenta dye-forming coupler, and (c) still further from the support, a blue record comprising in order from the support, a less and a more blue light sensitive silver halide emulsion layer, each having associated therewith at least one yellow dye-forming coupler;

wherein:

(d) there is located, below and only below the most red light sensitive layer of the red record, a relatively non-light sensitive red light reflective 3-D silver halide emulsion layer containing 3-D grains which have a proportion of 3-D grains of an ECD in the range of from 0.10 to 0.80 $\mu$m sufficient to improve the red speed of the element without degrading the sharpness of the element.

14. A method of forming an image comprising contacting the element of claim 1, after imagewise exposure to light, with a color developing compound.

* * * * *